United States Patent [19]

Yasunaga et al.

[11] Patent Number: 4,674,896

[45] Date of Patent: Jun. 23, 1987

[54] PRINTING MECHANISM FOR AN IMPACT MATRIX PRINTER

[75] Inventors: Makoto Yasunaga; Yasuhiro Kon, both of Tanashi, Japan

[73] Assignee: Citizen Watch Co., Ltd., Tokyo, Japan

[21] Appl. No.: 743,680

[22] Filed: Jun. 11, 1985

[30] Foreign Application Priority Data

Jun. 12, 1984 [JP] Japan ..... 59-87845[U]

[51] Int. Cl.[4] ..... B41J 3/12

[52] U.S. Cl. ..... 400/124; 101/93.05

[58] Field of Search ..... 400/124; 101/93.05; 335/271, 277

[56] References Cited

U.S. PATENT DOCUMENTS 4,244,658 1/1981 Mori ..... 400/124

4,498,791 2/1985 Gilbert ..... 400/124

FOREIGN PATENT DOCUMENTS 202863 11/1984 Japan ..... 400/124

*Primary Examiner*—Paul T. Sewell

*Attorney, Agent, or Firm*—Birch, Stewart, Kolasch & Birch

[57] ABSTRACT

A printing mechanism has a cantilevered leaf spring of magnetic material and an electromagnet. A cantilevered first thin plate of magnetic material is disposed between the leaf spring and a core of the electromagnet. A second thin plate of nonmagnetic material is secured to the first thin plate adjacent to the leaf spring. A permanent magnet is provided to attract the leaf spring and the first thin plate to the core and to attract the first thin plate by residual magnetism upon energization of the electromagnet.

3 Claims, 3 Drawing Figures

PRINTING MECHANISM FOR AN IMPACT MATRIX PRINTER

BACKGROUND OF THE INVENTION

The present invention relates to a printing head for an impact matrix printer.

The impact matrix printer comprises a plurality of printing elements, each comprising a permanent magnet, a leaf spring having a stylus, and an electromagnet consisting of a core and a coil. When the electromagnet is energized, the leaf spring is released, so that the stylus impacts the surface on which printing is performed.

In such a printer, a thin plate or film of nonmagnetic material such as stainless steel or polyimide resin is disposed between the top of the core and the leaf spring in order to enhance the release of the leaf spring from the top of the core upon the energization of the electromagnet, and to absorb the shock at the impact of the leaf spring on the top of the core. However, the film of polyimide resin becomes soft at a high temperature of over 100° C., so that the film becomes broken by impact of the leaf spring.

In a printer in which the thin film of stainless steel is cantilevered, the leaf spring is attracted to the top of the core by the permanent magnet, interposing the film. When the coil is energized, the leaf spring rotates about a pivot and also the film rotates following the leaf spring about a center adjacent the cantilevered portion. In such a printing mechanism, the film slightly moves and slides on the top of the core in the radial direction, when disengaging and impacting from and on the top of the core. The movement of the film in the radial direction is caused by the rotational movement of the film. The sliding of the film on the top of the core causes the core and the film to wear. Since the core is made of a soft metal, it may become considerably worn.

Accordingly, the air gap between the film and the top of the core changes with the wearing, which results in deterioration of the printing quality. In addition, if the thin film is secured to a support by the welding thereof, the film may be corrugated. Accordingly, the amount of the air gap increases, resulting in an increase of differences among individuals in air gap, thereby causing extreme decreases of impact forces at particular printing elements.

SUMMARY OF THE INVENTION

The object of the present invention is to provide a printing mechanism in which a thin film disposed between a leaf spring and a core of an electromagnet is provided so as not to move on the top of the core during the printing operation, whereby the leaf spring and the core are prevented from wearing to improve the printing quality.

According to the present invention, the printing mechanism has a cantilevered leaf spring of magnetic material having an armature and a print wire secured at a free end thereof, and an electromagnet comprising a core and a coil. A first thin plate of magnetic material is cantilevered and disposed between the leaf spring and top of the core of the coil and a second thin plate of nonmagnetic material is secured to the first thin plate adjacent to the leaf spring. A permanent magnet is provided to attract the leaf spring and the first thin plate to the core and to attract the first thin plate by residual magnetism upon energization of the electromagnet in opposite polality to that of the permanent magnet.

These and other objects and features of the present invention will become more apparent from the following description with reference to the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1:
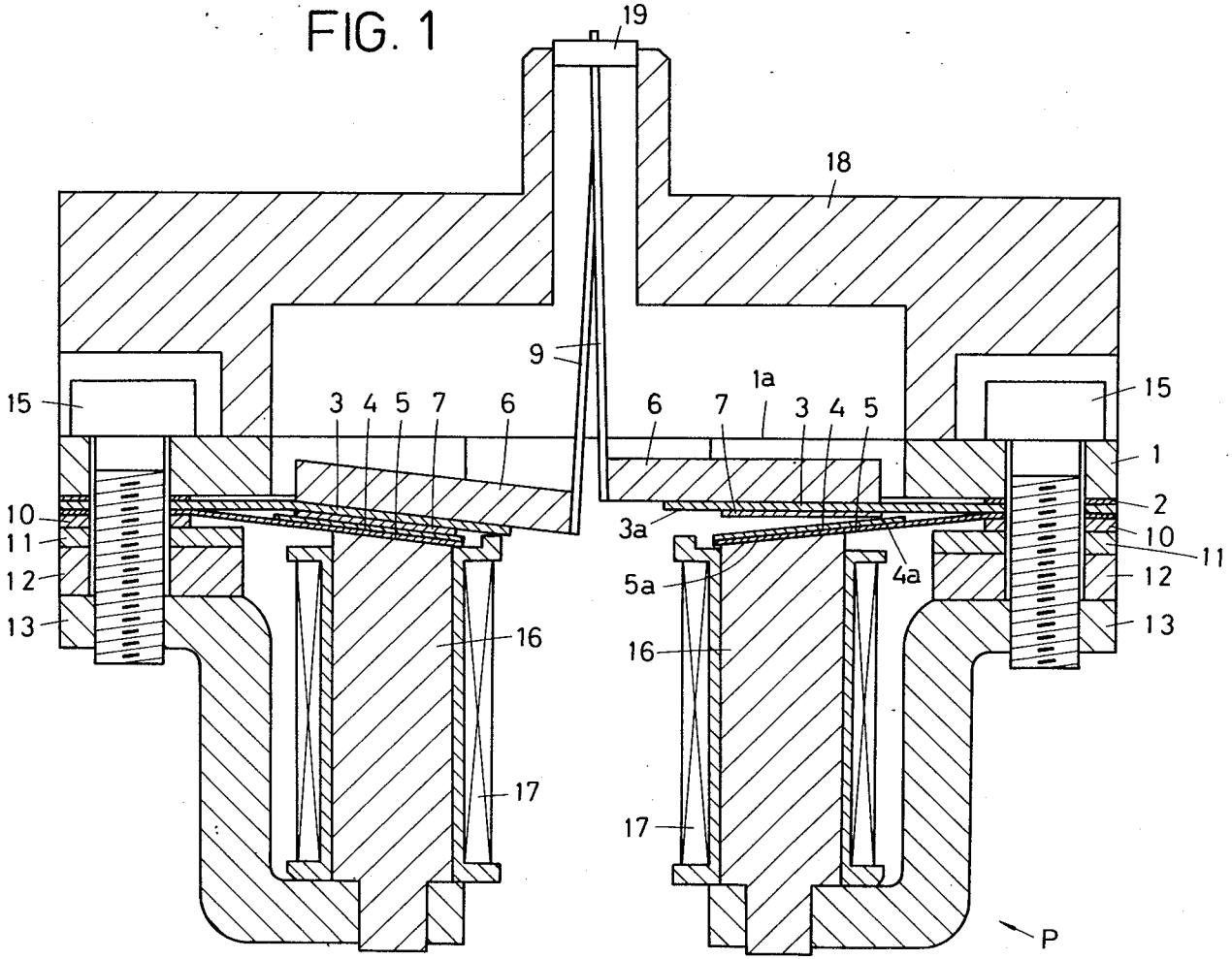
FIG. 1 is a sectional view of a printing head for an impact matrix printer according to the present invention.
Figure 2:
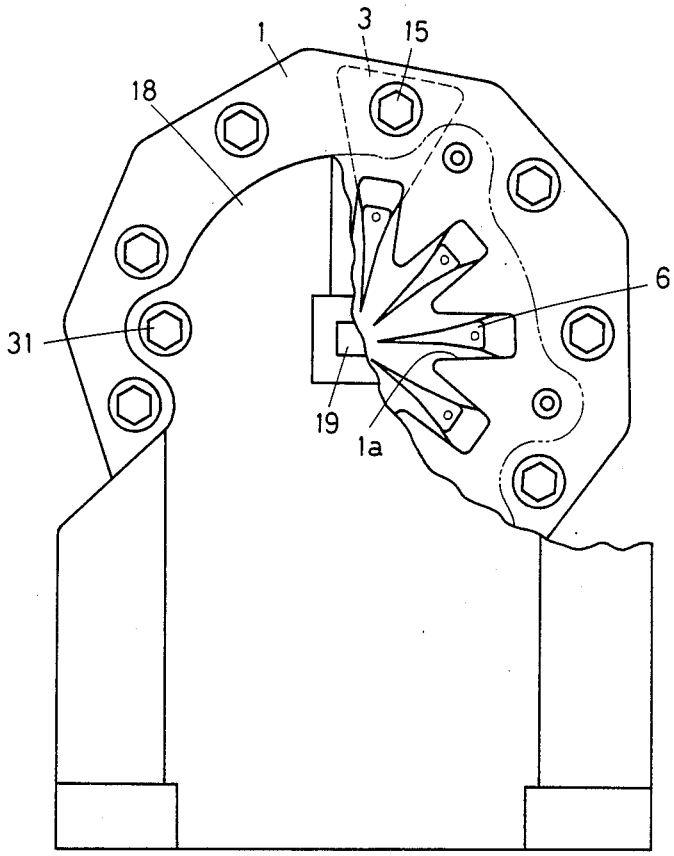
FIG. 2 is a front view of the printing head, a part of which is broken away.
Figure 3:
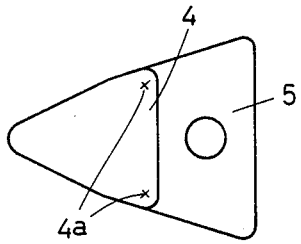
FIG. 3 is a plan view of thin plates.

Referring to FIGS. 1 to 3, a supporting member or first yoke 1 for printing mechanisms is mounted on a frame 18 made of nonmagnetic material by screws 31. A plurality of printing mechanisms P are circularly disposed on the rear side of the first yoke 1 about a center point of the printing head, interposing a spacer 2.

Each printing mechanism comprises a leaf spring 3, and a first thin plate 5 of magnetic material. The shape of thin plate 5 is similar to the leaf spring 3 in plan view. To the front side of the leaf spring 3, an armature 6 is secured at a free end portion 3*a*, and a reinforcement plate 7 is secured to the free end portion 3*a* on the rear side of the leaf spring 3 opposite to the armature 6. A print wire 9 is securely mounted on a tip end of the armature 6. The first thin plate 5 has a second thin plate 4 of nonmagnetic material, corresponding to the reinforcement plate 7 on leaf spring 3. The first thin plate 5 has a thinner thickness than the leaf spring 3 so as to have a very small elasticity compared with the leaf spring. The second thin plate 4 is secured to a free end portion 5*a* of the first thin plate 5 by spot welding at welding points 4*a*. It is preferable that the Vickers hardness of each thin plate is over 500 and the thickness is between 2/100–5/100 mm.

On the rear side of the first thin plate 5, a magnet supporting plate 11 is disposed, interposing a second spacer 10. Mounted on the magnet supporting plate 11 is a permanent magnet 12, on the other side of which a second yoke 13 is disposed. A core 16 is provided on an end of second yoke 13 and disposed such that the top of the core is positioned adjacent to the free end portion 5*a* of the first thin plate 5. A coil 17 wound on the core 16 is connected to an electric circuit (not shown). The spacer 2, leaf spring 3, first thin plate 5, spacer 10, magnet supporting plate 11 and permanent magnet 12 are superimposed between the first and second yokes 1 and 13 and secured by a screw 15. The first yoke 1 has a plurality of notches 1*a* surrounding armatures 6. End portions of print wires 9 are arranged on the straight in a print wire quide 19 provided on a projected end portion of the frame 18.

In operation, the magnetic circuit of flux produced by the magnetomotive force of the permanent magnet 12 is provided in the order of the magnet supporting plate 11, second spacer 10, first thin plate 5, leaf spring 3, first spacer 2, first yoke 1, armature 6, free end portion 3*a* of leaf spring 3, reinforcement plate 7, core 16 and second yoke 13. Thus, the free end portion 5*a* of the first thin plate 5 having the second thin plate 4 is attracted to the core 16 and the leaf spring 3 is also attracted to the core 16 interposing thin plates 4 and 5 against the elasticity of the leaf spring 3. When the coil 17 is excited in opposite polality to that of the permanent magnet to reduce the magnetomotive force of the permanent magnet 12, the attraction between the core 16 and leaf spring 3 is reduced. Thus, the leaf spring 3 attracted to the core 16 through the nonmagnetic second thin plate 4 is immediately released from the core 16 and the leaf spring 3 is driven by the elastic force of the spring and the print wire 9 impacts a paper web (not shown) to print a dot.

Between the leaf spring 3 and the core 16, the thin plate 5 of magnetic material is disposed adjacent to the core 16. Since the thickness of the thin plate 5 is small to have a very small elasticity compared with the leaf spring 3, the thin plate 5 remains on the top of the core 16 by the residual magnetism of the permanent magnet 12.

In accordance with the present invention, the thin plate 5 sticks to the core 16 upon excitation of the coil 17. Thus, thin plate 5 does not slip on the core 16, thereby preventing the abrasion of the thin plate, especially of the core made of soft metal.

Further, the second thin plate 4 of nonmagnetic material is disposed between the leaf spring 3 and core 16 to serve as a magnetic shield for reducing magnetic flux, so that the releasing characteristic of the leaf spring 3 is improved.

While the invention has been described in conjunction with preferred specific embodiments thereof, it will be understood that this description is intended to illustrate and not limit the scope of the invention, which is defined by the following claims.

What is claimed is:

1. A printing mechanism for an impact matrix printer comprising:

first and second yokes for supporting members;

a leaf spring made of a magnetic sheet having a fixed portion and a movable portion;

an armature secured to the movable portion of the leaf spring at one side thereof;

a print wire secured to the armature;

an electromagnet comprising a core secured to the second yoke and a coil;

a first plate made of a magnetic flexible sheet adjacent to the other side of the leaf spring and having a fixed portion and a movable portion which has a first side adjacent to the top of the core;

a second plate made of a nonmagnetic sheet secured to the movable portion of the first plate at a second side opposite the leaf spring;

a permanent magnet provided to attract the leaf spring and the first plate to the core; and means for superimposing and securing the fixed portions of the leaf spring and first plate and permanent magnet between the first and second yokes.

2. The printing mechanism in accordance with claim 1 wherein the core is secured to a second yoke, and the leaf spring, first thin plate, permanent magnet are disposed between the first and second yokes and secured to the first yoke by a screw.

3. The printing mechanism in accordance with claim 1 wherein the Vickers hardness of each thin plate is over 500 and the thickness is between 2/100–5/100 mm.

* * * * *